US012768120B2

(12) United States Patent
Roberts

(10) Patent No.: US 12,768,120 B2
(45) Date of Patent: Oct. 20, 2026

(54) BOUYANCY-ASSISTED WEIR

(71) Applicant: VERDERG LIMITED, Woking Surry (GB)

(72) Inventor: Peter Roberts, Woking (GB)

(73) Assignee: Verderg Limited, Woking Surry (GB)

( * ) Notice: Subject to any disclaimer, the term of this patent is extended or adjusted under 35 U.S.C. 154(b) by 182 days.

(21) Appl. No.: 18/278,462

(22) PCT Filed: Feb. 8, 2022

(86) PCT No.: PCT/GB2022/050337
§ 371 (c)(1),
(2) Date: Aug. 23, 2023

(87) PCT Pub. No.: WO2022/180356
PCT Pub. Date: Sep. 1, 2022

(65) Prior Publication Data

US 2024/0133143 A1 Apr. 25, 2024
US 2024/0229399 A9 Jul. 11, 2024

(30) Foreign Application Priority Data

Feb. 24, 2021 (GB) ..... 2102604

(51) Int. Cl.
*E02B 7/06* (2006.01)
*E02B 3/02* (2006.01)
(Continued)

(52) U.S. Cl.
CPC ..... *E02B 7/16* (2013.01); *E02B 3/02* (2013.01); *E02B 9/08* (2013.01)

(58) Field of Classification Search
CPC .. E02B 15/0814; E02B 15/0878; E02B 7/005; E02B 3/104; E02B 7/16; E04H 9/145; E06B 2009/007
See application file for complete search history.

(56) References Cited

U.S. PATENT DOCUMENTS 495,788 A * 4/1893 Debarle ..... E02B 7/005 405/115
3,852,964 A * 12/1974 Ballu ..... E02B 15/08 405/63

(Continued)

FOREIGN PATENT DOCUMENTS

AT 503656 12/2007
CN 1408958 A 5/2008

(Continued)

OTHER PUBLICATIONS

PCT Search Report for PCT/GB2022/050337, Sep. 1, 2022.
UK IP Office Combined Search and Examination Report, App. GB2102604.2, Jul. 29, 2021.

*Primary Examiner* — Benjamin F Fiorello
(74) *Attorney, Agent, or Firm* — Woods Rogers PLC; Timothy J. Bechen; Nathan Evans

(57) ABSTRACT

A weir comprising: a water impervious flexible membrane; a buoyancy member; and a tether, wherein, in use, the membrane comprises a lower edge portion and an upper edge portion, the lower edge portion is fixed with respect to a bed of a body of water, the membrane and the buoyancy member are attached to one another in the upper edge portion, and the tether comprises a first end portion, which is attached to the buoyancy member and/or to the membrane in the upper edge portion, and a second end portion that is attached to an anchorage.

18 Claims, 18 Drawing Sheets

(51) Int. Cl.
*E02B 7/16* (2006.01)
*E02B 9/08* (2006.01)

(56) References Cited

U.S. PATENT DOCUMENTS 3,974,655 A * 8/1976 Halpern ..... E02B 7/005 405/115
4,102,134 A * 7/1978 Margen ..... E02B 15/08 405/53
4,201,495 A * 5/1980 Preus ..... E02B 15/08 405/63
4,252,461 A 2/1981 Colamussi et al.
4,358,220 A * 11/1982 Gutierrez Atencio .... E02B 9/00 405/75
5,154,537 A * 10/1992 DeVries ..... E02B 15/0885 405/74
5,385,427 A * 1/1995 Kateley ..... E02B 15/0864 405/63
5,688,075 A * 11/1997 Gradek ..... E02B 15/0885 405/63
6,216,399 B1 * 4/2001 Belarbi ..... E02B 3/104 405/114
6,743,367 B2 * 6/2004 Dreyer ..... E02B 15/0814 405/63
9,085,864 B2 * 7/2015 Ortiz ..... E02B 7/005
9,708,785 B1 * 7/2017 Bollman ..... E02B 3/108
10,011,966 B1 * 7/2018 Shaw ..... E02B 7/005
10,024,014 B1 * 7/2018 Carter ..... E02B 15/0814
10,557,239 B1 * 2/2020 Malaney ..... E02B 3/12
2003/0010727 A1 * 1/2003 Gunderson, III ..... E02B 15/06 210/803
2007/0245942 A1 10/2007 Sestito
2018/0044871 A1 * 2/2018 Carney ..... E02B 3/02
2019/0284775 A1 * 9/2019 Pan ..... E02B 7/005

FOREIGN PATENT DOCUMENTS

CN 21149877 U 8/2020
DE 19545313 5/1997
GB 1594528 7/1981
GB 2488809 9/2012
JP 2003119751 4/2003

* cited by examiner

BOUYANCY-ASSISTED WEIR

The present application is the National-stage filing of and relies on the disclosures of and claims priority to and the benefit of PCT Patent Application PCT/GB2022/050337 filed Feb. 8, 2022 with an original priority date of Feb. 24, 2021 based on UK Patent App. 2102604.2, the disclosures of which are hereby incorporated by reference herein in their entireties.

TECHNICAL FIELD

This disclosure relates to a weir. In particular, to a buoyancy-assisted weir that is suitable for creating a head rise in a body of water.

BACKGROUND ART

Conventional weirs, barrages and dams in bodies of water such as rivers, streams, canals and estuaries have been installed over thousands of years to convert hydraulic kinetic energy in the flow into potential energy which can then be converted into useable mechanical energy. However, they suffer from disadvantages which can erode or negate this useful property, as further described.

When there is a large discharge of water upstream, weirs, barrages and dams act as an obstruction to the flow of water down the river, and can increase the damage caused upstream as the water is prevented (or at least slowed) from flowing down the river and instead backs up behind the weir.

Conventional weirs require significant civil works to build and are therefore costly and time-consuming to erect. Conventional weirs provide a barrier to water-borne craft and to the free passage of fish and other aquatic animals. Conventional weirs can have a negative visual impact environmentally.

Automatic gates in weirs are known, which are aimed at limiting the obstructive nature of weirs. These open to allow larger volumes of water than normal to flow down the river. However, current arrangements comprise complicated systems requiring significant maintenance to move the gates between the closed and open positions in order to cope with excess flows of water.

For example, EP0374170 discloses a weir that that uses separate floating counterweight connected to the weir gate by cable. The counterweight is located upstream of the weir to senses any rise or fall in the water behind the weir. Pressure exerted on the counterweight from a rise in water level causes the gate to drop to provide an opening in the weir to water to flow through.

Another example of an automated weir is known from GB2488809 in which a fabricated tank is hinged eccentrically to the river or sea bed and is supported by its buoyancy at an angle to the bed creating a head drop. A claimed property of this arrangement is that dynamic forces from unusually high flows automatically depress the elevation of the weir thus facilitating unimpeded flow.

A further example is U.S. Pat. No. 2,598,389, which describes a system comprising an upper gate and a lower gate. The lower gate extends into a lower chamber in the masonry of the weir with sufficiently close tolerances between gate and masonry to inhibit water ingress into the lower chamber. Water is admitted to the lower chamber through a duct when the water level rises behind the weir. The pressure of water applied to the lower gate in the chamber causes the gate to rotate about an axis extending between the upper and lower gate to lower the gate to allow water to flow through.

The present disclosure presents a very much lighter, less complex and less costly method of achieving the same objective as these previous filings that is also significantly easier to install and maintain.

The object of the invention is to provide a simple, cost effective and unobtrusive weir with potential for air transportability and rapid installation without major civil engineering works or equipment that can still allow large discharges of water to pass without undue impediment when appropriate.

The invention is expected to have several temporary and permanent applications including but not limited to flood protection and mitigation, provision of water storage for domestic or industrial use and irrigation particularly but not limited to in remote locations or during disaster relief, renewable energy generation both in watercourses and tidal flows and also in coastal erosion protection.

SUMMARY OF INVENTION

According to the present invention, in a first aspect, there is provided a weir comprising: a water impervious flexible membrane; a buoyancy member; and a tether, wherein, in use, the membrane comprises a lower edge portion and an upper edge portion, the membrane and the buoyancy member are attached to one another in the upper edge portion, the lower edge portion is fixed with respect to a bed of a body of water, and the tether comprises a first end portion, which is attached to the buoyancy member and/or to the membrane in the upper edge portion, and a second end portion that is attached to an anchorage.

In accordance with the first aspect, there is provided a weir for use in a body of water having a downstream side and an upstream side, which may be self-adjusting.

Preferably the membrane and the tether are attached to the buoyancy member at a common point on an outer surface of the buoyancy member as viewed in cross-section, and the membrane is wrapped partially around the buoyancy member. The membrane and the tether may extend away from the common point in opposed directions.

In use, the position of the weir in the water is determined primarily by the self-weight, dimensions and geometry of the comprised elements which define the tension forces in the tether and membrane in equilibrium with the buoyancy, all as caused by the water pressure acting on the membrane and buoyancy member. Additional forces will be experienced from flow crossing over the weir from upstream to downstream and any dynamic forces such as those experienced from wave action or tidal flow reversal which will cause automatic self-adjustment of the weir position.

When the weir is in an equilibrium position the tether may sit at an angle that is positive, zero or negative, relative to the horizontal, depending on the location and position of the anchorage. Where the tether slopes down to an anchorage at the base of the flow, the buoyancy will oppose the vertical component of the tension in the tendons and membrane. Where the tether slopes up to the anchorage at an elevation above the equilibrium position of the buoyancy member, there will be a vertical component of tension in the tether which augments the buoyancy including the limiting case where the buoyancy necessary to maintain the equilibrium position may reduce to zero.

There are preferably a plurality of the tethers provided.

Where the weir is exposed to waves in open water it responds in a compliant manner because the barrier it presents to a wave comprises a flexible membrane. Notably, an equivalent solid structural barrier would experience a significant impact resulting in reflection and/or refraction of an incident wave. By complete contrast, the flexible membrane can move with the wave particle motion absorbing much less of its energy and transmitting the rest of the wave energy into the water downstream on the other side of the membrane. This compliance contributes greatly to the superior economics of this invention.

Note also that for a fixed head difference across the weir, the only significant cost increase of a buoyant weir with increasing natural water depth at the site is due to the increased area of the membrane to accommodate the deeper water. A second order cost increase may be caused by the additional weight of the membrane necessitating a slight increase in the diameter of the buoyancy but this is mitigated or eliminated where the membrane fabric is partially or neutrally buoyant. By complete contrast, a conventional weir or dam can be expected to increase in volume and therefore cost in proportion approximately with the square of the water depth. The greater the water depth therefore, the greater the economic advantage of the buoyant weir for any given head drop to be created by the weir.

The cross sectional shape of the buoyancy member need not be limited. It can, for example, be circular, substantially triangular, rectangular or irregular. A circular shape is generally preferred. The buoyancy member may be formed from an inherently buoyant material. It may additionally or alternatively have a form that renders it buoyant. It may, for example, comprise a tube. The buoyancy member can comprise one long member. It may otherwise comprise a plurality of separate discrete members. The use of separate discrete buoyancy members is preferred, wherein more buoyant members can be provided over deeper sections of a body of water such that the weir top can remain horizontal despite the downwards forces on the buoyancy member being highest in deep water. A particularly preferred configuration for the buoyancy member is one comprising multiple tubular members. Such an arrangement would allow for continued operation in the event one or more of the members was damaged and water ingress occurred.

The buoyancy member preferably comprises one or more manifolds into which water or other liquid or gas can be introduced (and removed). The manifold(s) can be connected to one or more pumps for such purposes. By provision of a manifold, control over the position of the buoyant member, and thereby the weir, is possible. It may be raised or lowered as desired by increasing or decreasing its buoyancy.

As will be readily appreciated by those skilled in the art, and in conformity with conventional known arrangements, suitable provision will be made to limit seepage flow bypassing the weir beneath it and around its edges.

The downstream end of the buoyancy member can comprise a folded configuration of the membrane to retain the upstream water level whilst permitting changes to the weir configuration in cooperation with the substrata and any support or containment structure without dragging the membrane across the containment surface.

To minimise scour and by-pass flow the upstream end of the membrane can be attached to the top edge of a conventional seepage barrier driven into the substrata and attached to any structure at the ends of the barrier. Alternatively, the membrane can be anchored onto the substrata by friction generated from engineered back-fill dumped onto the membrane or by other suitable means. Where the membrane is thus restrained onto the substrata, the length of the membrane thereby held in contact with the substrata can be adjusted to provide a bypass seepage path sufficiently long to limit the bypass flow to a level where no seepage barrier is necessary.

A trench can be provided into which the buoyancy can be lowered in conjunction with the membrane and tether to provide minimal obstruction to the water flow or to waterborn vessels.

According to a second aspect of the invention, there is provided a method of generating energy from a body of water comprising: a weir, as described above, across the body of water; one or more bypass conduits for diverting a volumetric flow of water from the body of water upstream of the weir through the one or more bypass conduits and back into the body of water downstream of the weir; and a renewable energy device in the one or more bypass conduits to generate energy from the water as it flows through the one or more bypass conduits.

The one or more bypass conduits may comprise pipes or channels or otherwise.

Arrangements may be provided in which one or more upstream pipes rise above the upstream water level forming a siphon, for the flow from the upstream end of such a pipe to be primed by pumping out air or adding water at the highpoint of the pipe.

Further, preferable features are presented in the dependent claims.

BRIEF DESCRIPTION OF THE DRAWINGS

The invention will now be described by way of example with reference to the accompanying drawings.

MODE(S) FOR CARRYING OUT THE INVENTION

Figure 1:
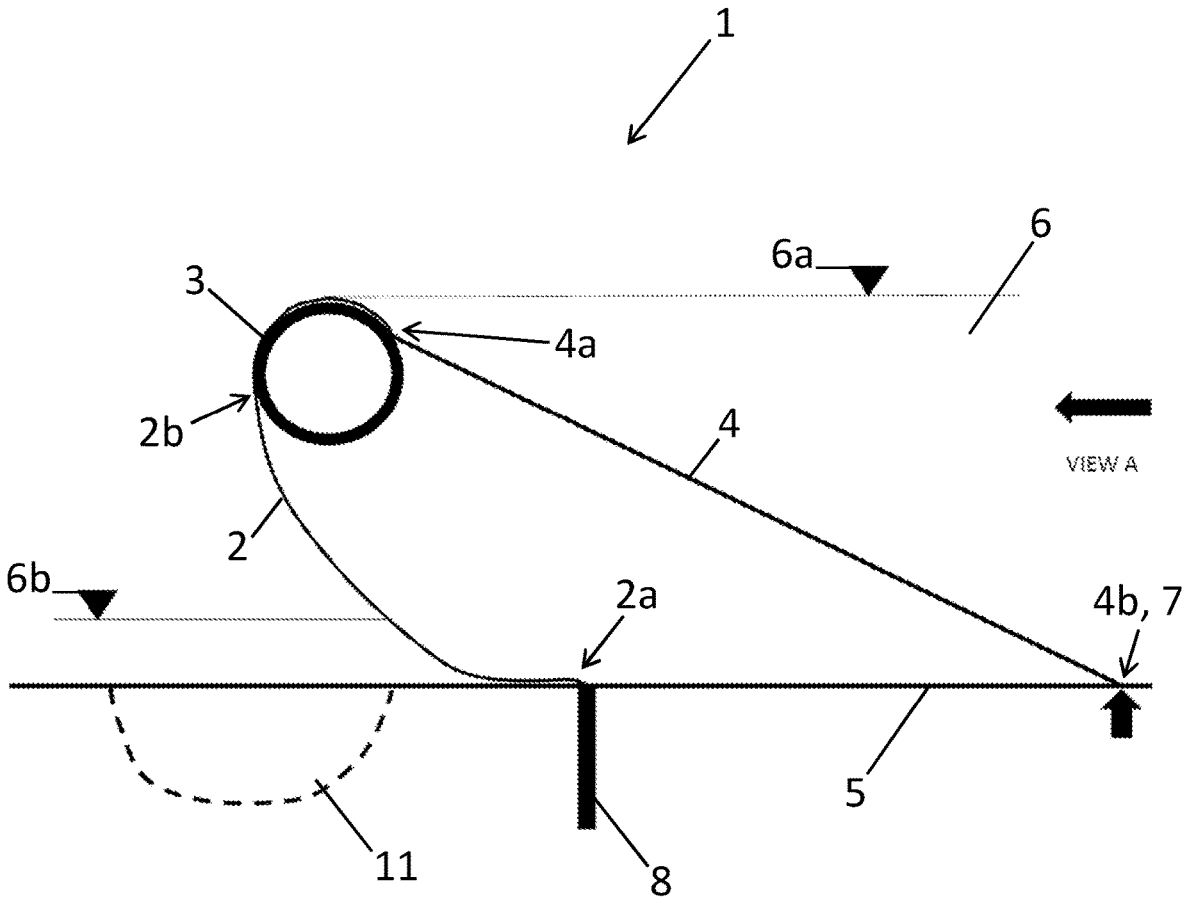
FIG. 1 shows a side view of a weir according to a first embodiment installed in a body of flowing water with the membrane anchored to a seepage barrier.

FIG. 1 shows a schematic sectional view of a weir 1 in accordance with a first embodiment of the invention in use in a body of water 6. The water levels upstream and downstream of the weir are labelled as 6*a* and 6*b*, respectively.

The weir 1, in common with all described embodiments, comprises a water impervious flexible membrane 2, a buoyancy member 3, and a tether (or tendon) 4. The membrane 2 comprises a lower edge portion 2*a* and an upper edge portion 2*b*. The lower edge portion 2*a* is fixed with respect to a bed 5 of a body of water 6. The membrane 2 and the buoyancy member 3 are attached to one another in the upper edge portion 2*b*. The tether 4 comprises a first end portion 4*a* that is attached to the buoyancy member 3 and/or to the membrane 2 in the upper edge portion 2*b* and a second end portion 4*b* that is attached to an anchorage 7.

In the present arrangement, as is preferred, the buoyancy member 3 is hollow and circular in cross-section. However, as discussed, it need not be limited as such and may have various alternative forms/profiles. For example, possible alternatively shaped cross-sections include, but are not limited to, triangular, rectangular or irregular cross sectional shapes. As also discussed, the buoyancy member 3 may comprise a single long tube or several discrete tanks that are joined to one another.

The membrane 2 in the present arrangement has its lower end 2*a* attached to the substrata of the bed 5 of the body of water 6. It may be otherwise fixed with respect to the bed 5. The body of water 6 may comprise a river or other watercourse. The buoyancy member 3 is restrained by the tether 4, which is fixed (upstream) at its second end portion 4*b* to the anchorage 7.

It is preferable that there is a plurality of tethers 4, which are placed at intervals along the length of the buoyancy member 3. The plurality of tethers are preferably attached at attachment points to the buoyancy member 3 (or to each tank making up the buoyancy member) in a symmetrical configuration, so as not to induce plan rotation of the buoyancy member 3.

The membrane 2 extends along the entire length of the weir such that water moving from upstream to downstream can only continue by flowing over the buoyancy member 3. In the present arrangement a seepage barrier 8 prevents or mitigates to an acceptable level any seepage flow beneath the membrane 2. Because the tether 4 prevents the buoyancy member 3 from moving downstream with any such flow, the membrane 2 will tend to curve out in the downstream direction (in a manner analogous to the sails of a squared-rigged ship but with the maximum extension lower down the curve because the hydrostatic pressure increases with depth).

The downstream-curved profile of this distorted shape preferably extends to an upper membrane touch-down point 30 (shown on the close-up view of FIG. 11) on the buoyancy member 3. This is achieved by a configuration, as shown, in which the membrane is caused to wrap partially around the buoyancy member 3. By such configuration, a significant sector of the buoyancy member 3 cross-section contacts the upstream water and therefore experiences an upwards buoyancy force. Alternative arrangements will be possible in which this is not the case.

Regardless of the attachment configuration of the membrane 2 and the buoyancy member 3, a buoyancy force will raise the buoyancy member 3 carrying with it the membrane 2 and raises the (downstream) first end portions 4*a* of the tethers 4.

Equilibrium is reached at an upstream water level 6*a* and downstream water level 6*b* at which instant the buoyancy force equals the components of the tensions in the tethers 4 and also in the membrane 2 which is in turn a consequence of the weight of water supported in the distended volume of the membrane 2 that sits downstream of the intersection of the membrane 2 with the downstream water level 6*b* plus the self-weight of all components, as will be readily appreciated by those skilled in the art.

It is preferable that the weir 1 of any disclosed arrangement herein, including that of FIG. 1, can be connected to a ballasting pump and/or air pump (10, FIG. 2) to provide manual raising and lowering of the weir if required. A conventional manifold or manifolds can be incorporated into the buoyancy member 3, wherein flooding and de-ballasting of the barrier will allow for it to be lowered or raised as desired. Water can be introduced into the buoyancy member 3 to lower the barrier by increasing the effective self-weight. The pumps can also be configured to remove water from interior of the buoyancy 3 to reduce the effective self-weight and raise the barrier to a higher elevation. This ability to manually raise and lower the weir is useful to provide an unobstructed passage for water-born traffic, fish or floating debris if required. The ability to manually ballast and de-ballast the barrier is also useful when installing or removing the barrier from its site. A trench 11 in the river or other watercourse bed 5 can be provided in respect of any of the disclosed arrangements into which the buoyancy member 3 can be lowered.

Figure 2:
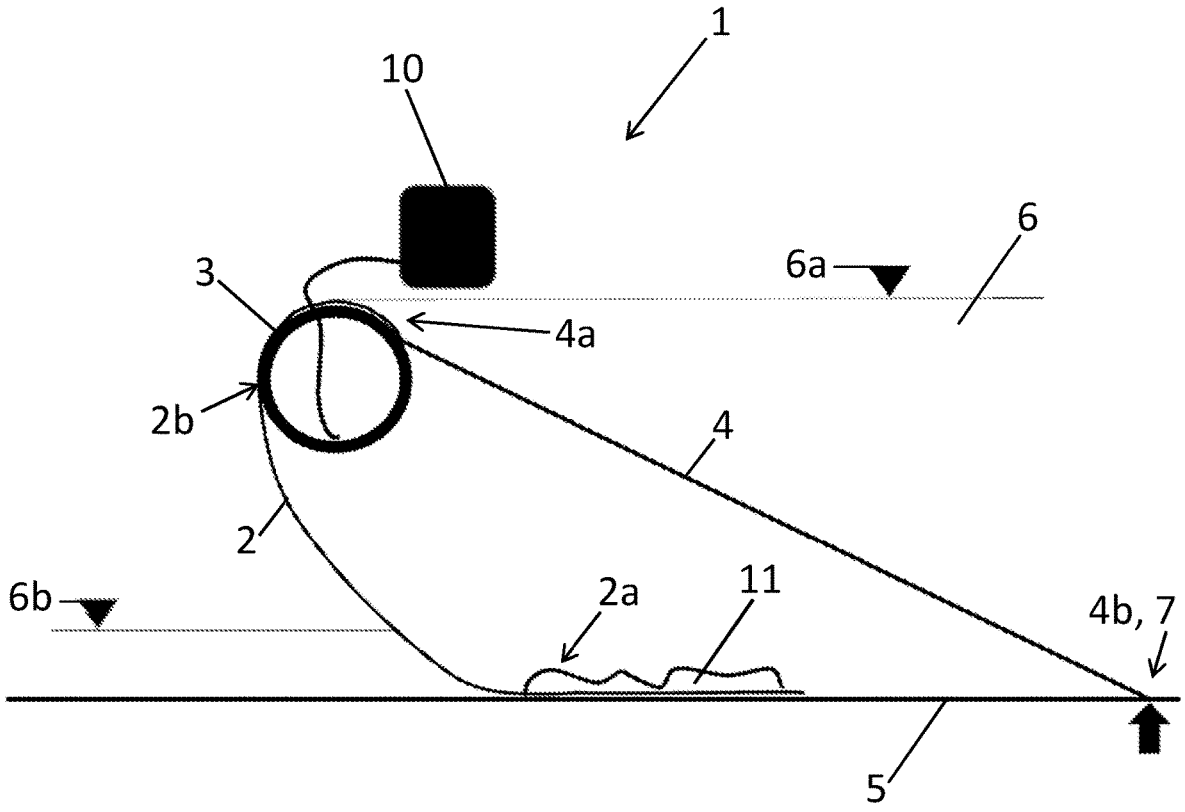
FIG. 2 shows a side view of a weir according to a second embodiment installed in a body of flowing water with the membrane anchored by engineered back-fill spread over the membrane.

FIG. 2 discloses an alternative configuration to FIG. 1 in which by-passing seepage beneath the membrane 2 is prevented or mitigated by extending the length of the membrane 2 that is in physical contact with the river or other watercourse bed 5 such that the increased physical length of the seepage path between upstream and downstream is sufficient to inhibit the by-pass flow to a satisfactory minimum. In this case the physical seepage barrier 8 driven down into the substrata of the river or other watercourse bed is no longer required to limit the seepage volume. To provide a suitable anchorage for the membrane 3, an adequate weight of engineered back-fill 11, or other suitable material or weighted members, may be placed on top of this extended length of the membrane 2.

FIG. 2 also shows that any configuration of buoyant weir can be connected to a ballasting and/or air pump 10, as discussed above.

Figure 3:
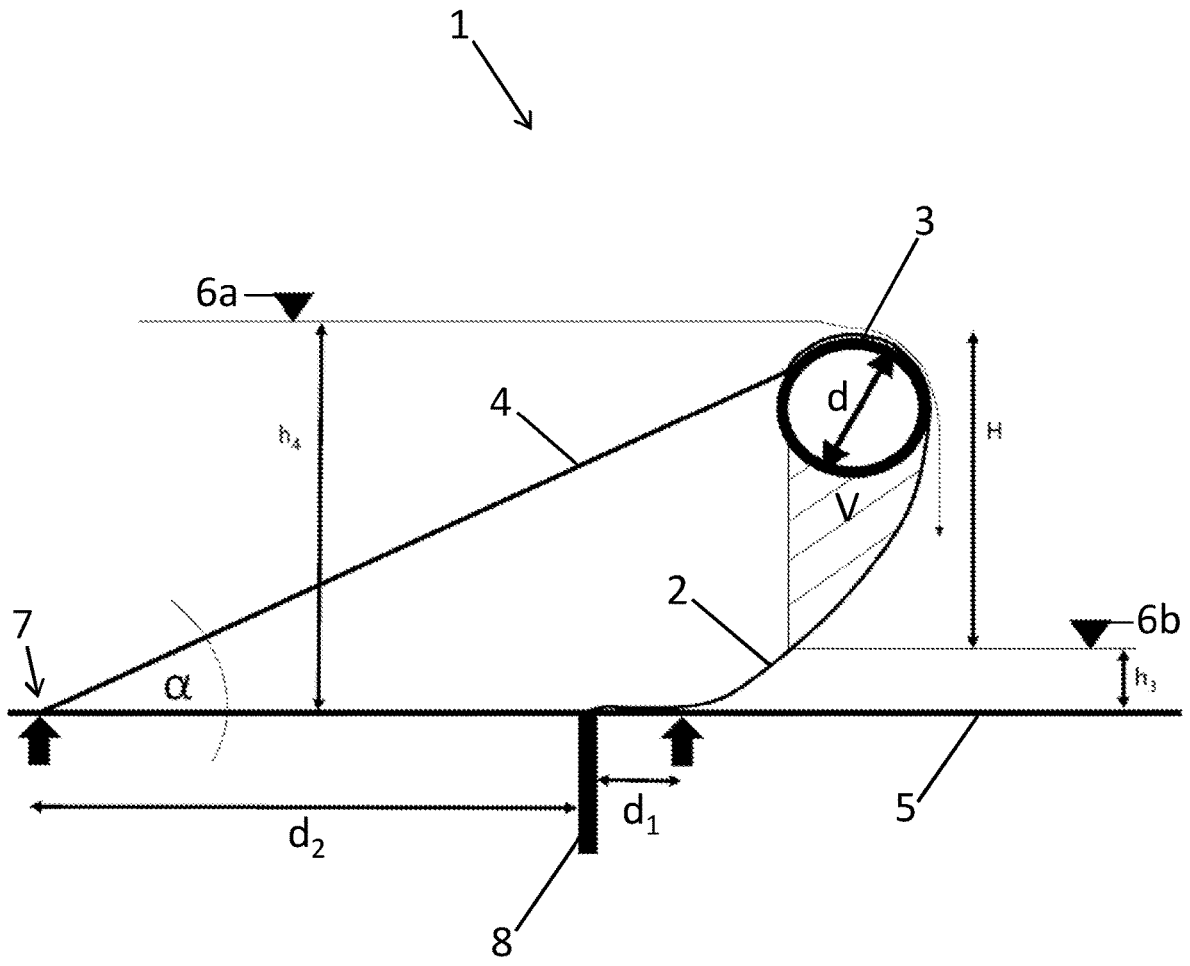
FIG. 3 shows a side view of a weir having a structure in accordance with the arrangement of FIG. 1 installed across a body of flowing water identifying the key design parameters.

FIG. 3 considers exemplary design parameters/exemplary parameters which may impact design considerations. Such parameters will vary from installation to installation, with the weir 1 configured accordingly, as will be readily appreciated by those skilled in the art. In FIG. 3, in contrast to FIGS. 1 and 2, the direction of flow is left to right.

The parameters include:

- The upstream water depth $h_4$ and the downstream water depth $h_3$, the difference between which is the head H.
- The distance $d_1$ from the seepage barrier 8 to a membrane touch-down point on the river or other watercourse bed 5.
- The distance $d_2$ between the seepage barrier 8 and the tether anchor 7, wherein this distance influences the angle $\alpha$ of the tether 4 with the river or other watercourse bed 5.
- The length of tether 4 and the position of its anchorage.
- The buoyancy force from the buoyancy member 3, resulting from the external diameter d and/or the configuration of the buoyancy element.
- The volume of water V each unit length of the buoyancy element must support. This is the volume with a cross-sectional area between the membrane 2 and a vertical line rising from the intersection of membrane 2 and downstream water level 6*b* with whichever is the first intersection from either the buoyancy member 3 or the upstream water level 6*a*.
- The developed length l of the membrane 2 (indicated on FIG. 13).
- The deadweight of all components.
- The water density.

FIG. 3 also shows that as flow continues from the instantaneous equilibrium position of FIGS. 1 and 2, the buoyancy member 3 will rise to a point where water will eventually flow over the top of the buoyancy member 3 forming a weir. The water depth over the top of the buoyancy member 3 and the downstream river level will increase. A new equilibrium position for the buoyant barrier will be assumed to maintain the head difference H between the upstream and downstream water levels 6*a*, 6*b* whilst accommodating the weight and hydrodynamic forces of water flowing over the top of the buoyancy member 3.

Figure 4:
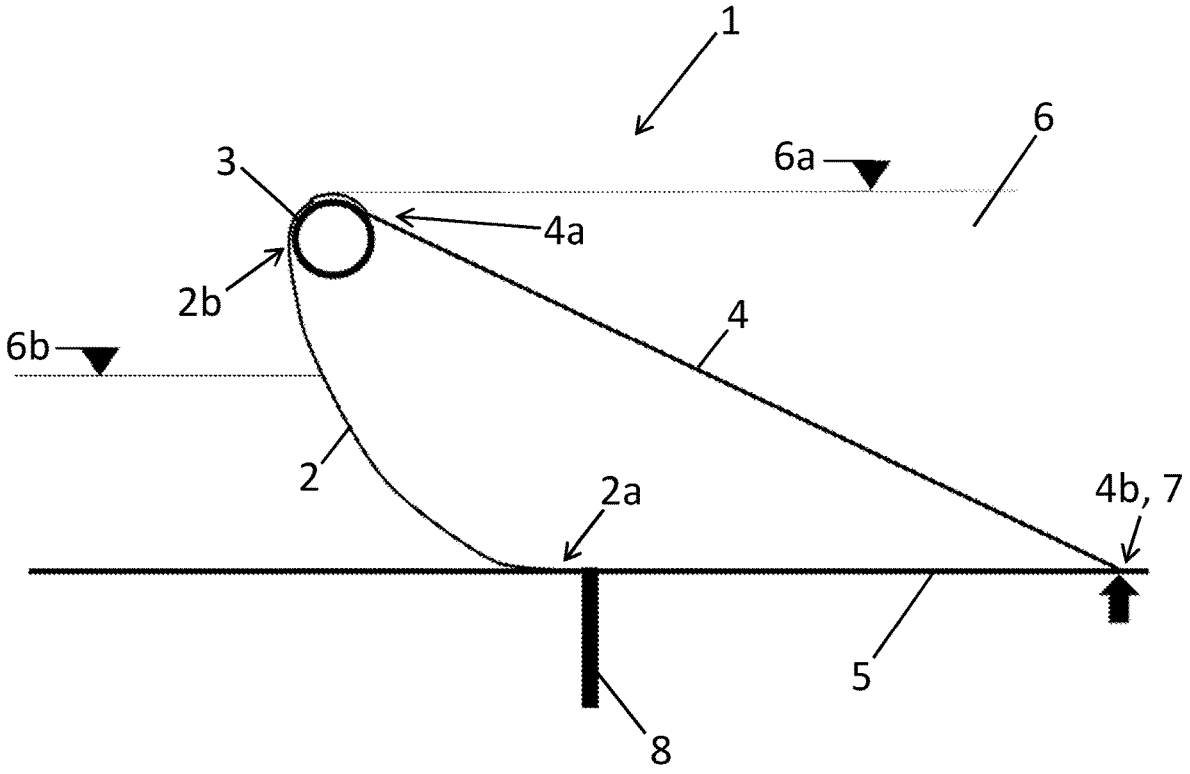
FIG. 4 shows a side view of a weir having a structure in accordance with the arrangement of FIG. 1 installed in deep open water with no waves present.

FIG. 4 shows a similar arrangement to FIG. 1, however, the installation is in deeper water, such as in open water offshore, with a smaller percentage of the membrane 2 above the downstream water level 6*b*. As in the arrangements depicted in FIGS. 1 and 2, there are no waves present. The general shape of the membrane 2 is as shown in FIGS. 1 and 2.

Figure 5:
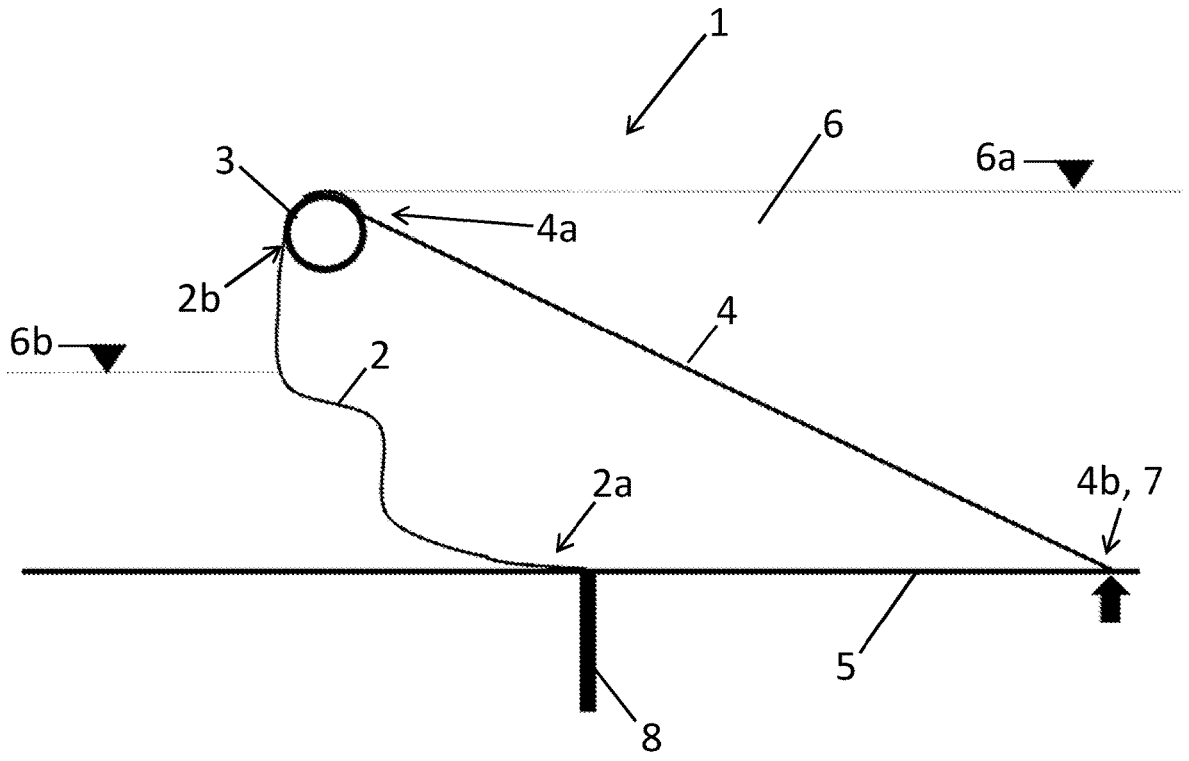
FIG. 5 shows a side view of the arrangement of FIG. 4 with waves present to demonstrate the compliance of the membrane with wave particle motion permitting through transmission of wave energy.

FIG. 5 shows the arrangement of FIG. 4 with waves present. Dynamic forces from incident upstream wave particle motion change the shape of the membrane 2 as shown in FIG. 5, wherein the membrane 2, owing to its flexible form, will exhibit classic compliant structural behaviour. The revised shape of membrane 2 in turn communicates some of the water particle motion to the water immediately downstream of membrane 2 limiting the amount of wave energy having to be absorbed by the compliant buoyant weir 1 by onward part-propagation of the wave into the flow downstream of the weir 1.

Figure 6:
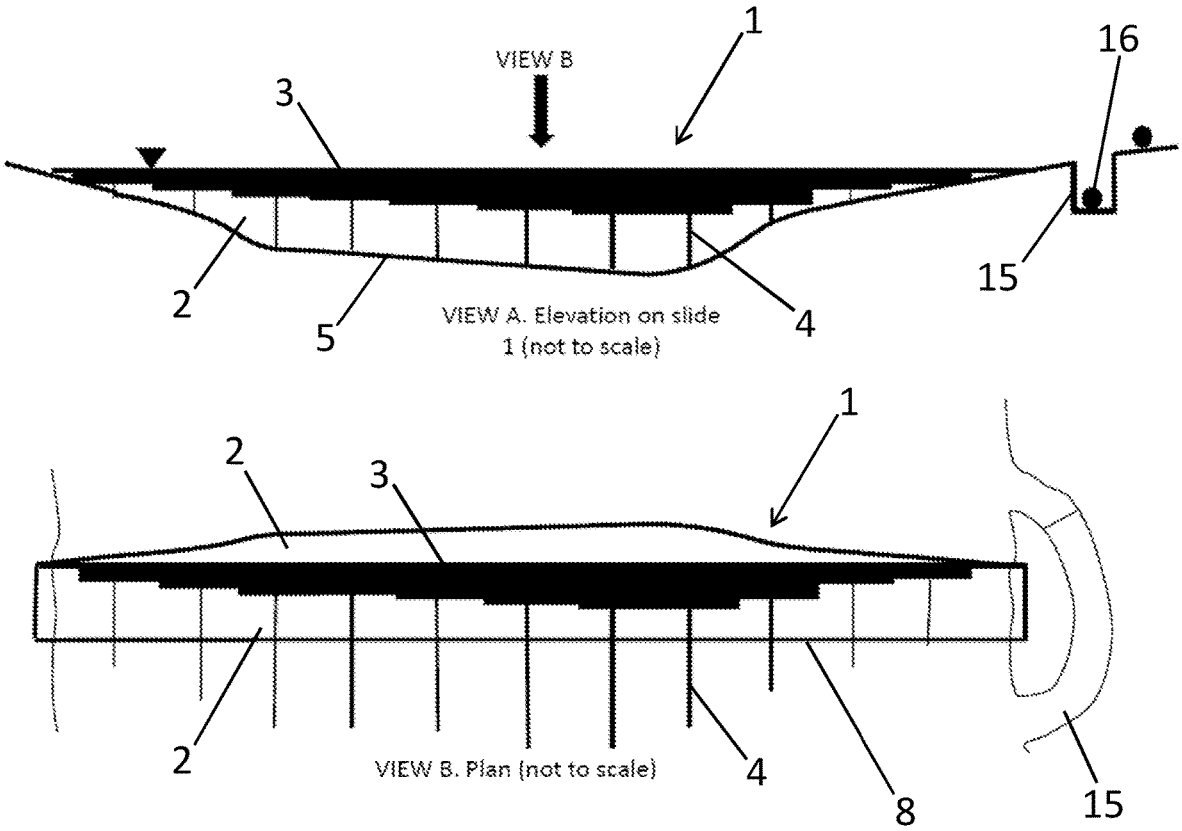
FIG. 6 shows an upstream elevation and a plan view of the weir of FIG. 1 installed across a river with tethers anchored to the river bed, including a power generation arrangement.

FIG. 6 is an elevation view from upstream and a corresponding plan view of a weir according to the arrangement of FIG. 1 spanning a river. The elevation shows that as the river bed 5 varies in depth across the river, the size of the individual tanks forming buoyancy member 3 may vary in buoyancy/size with the largest buoyancy provided to hold the membrane 2 over the deepest parts. Also indicated diagrammatically is the possibility that the width/strength of the tethers 4 may also be largest at these deepest sections where the applied forces will be highest. The plan view also shows that the tethers 4 at the greatest depths are the longest. The membrane 2 is shown in the plan view attached to the top of the seepage barrier 8 at its upstream end and bulging out downstream of the buoyancy member 3 by varying displacements with the largest bulge at the deepest sections. Also indicated is that the membrane 2 preferably extends a short distance up the river banks above the high water mark to prevent by-pass flow.

FIG. 6 also discloses a non-limiting example of a renewable energy generation function that a weir 1 according to the principles of the present disclosure can provide. A bypass channel 15 is provided. The channel 15 in the present arrangement houses a bypass pipe 16 with integral renewable energy generator such as a turbine. It should be appreciated that various alternative power generation arrangements/means may be provided. For example, a bypass channel could be provided to directly accommodate a power generation means, such as a waterwheel or Archimedes screw (24), or otherwise. A further option is where a by-pass pipe with integrated renewable energy generator is only partially buried in the channel or, wherein the channel is omitted and the pipe lies on the surface of the bank, or is otherwise exposed, with both ends dipping down into the upstream and downstream flow respectively. Where such an option is employed and the upstream water level is below the elevation of some part of the pipe, thus forming a siphon, flow can be primed by evacuation of air from or by the injection of water into the pipe at its highest point. The form of the bypass power generation is not to be limited.

Note that in accordance with the principles of the present disclosure, where the volumetric flow rate in the body of water intercepted by the weir varies up or down, the buoyant weir self-adjusts its elevation to suit and thereby remains visually unobtrusive at all times of normal operation. Considering the arrangement of FIG. 6, where some of the flow is caused to bypass the weir 1, the weir 1 will automatically lower its elevation to match.

In the arrangements discussed with reference to FIGS. 1 to 6, the tethers are anchored to bed 5 (at a level below the buoyancy member 3). With the anchorages 7 below the level of the buoyancy member 3, a positive angle $\alpha$, as shown in FIG. 3 is created. It is to be noted that the tethers may be otherwise mounted, wherein any discussed weir 1 may be modified to accommodate alternatively configured/located anchorages to suit the area of installation, to make installation easier, or otherwise. The tethering arrangement may be adapted to suit the installation location, or otherwise, as will be readily appreciated by those skilled in the art. The anchorages 7 may be provided above or below the level of the buoyancy member.

Figure 7:
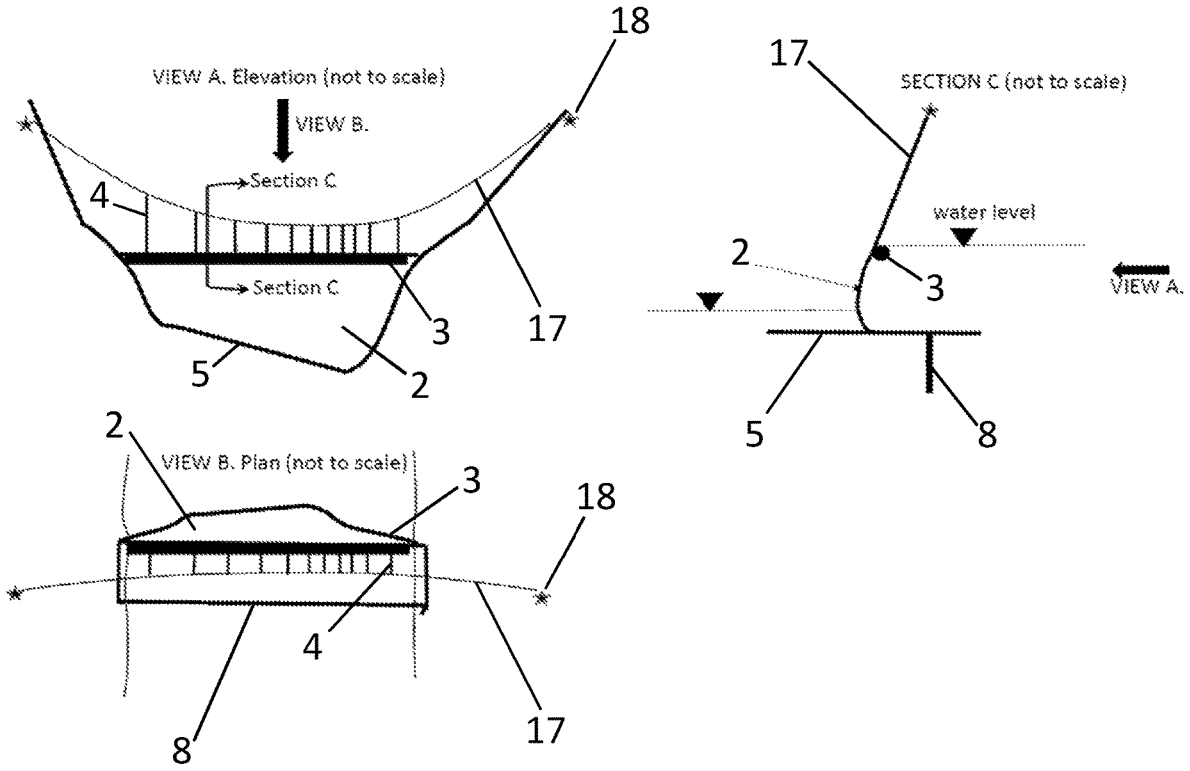
FIG. 7 shows an upstream elevation and a plan view of a weir installed across a steep-banked river with tethers anchored to a catenary cable anchored on each bank and stretched across and above the river.

FIG. 7 shows a plan view and upstream and side elevation views of an exemplary arrangement in which anchorages 7 are provided above the level of the buoyancy member 3. The angle $\alpha$ in this case is negative. In the arrangement of FIG.

7 a catenary cable 17 is stretched between two catenary cable anchors 18 and the tethers 4 stretch between the catenary cable 18 and the buoyancy member 3. In this arrangement, the catenary cable 18 effectively defines the anchorage 7 for the tethers 4. In alternative arrangements, the catenary cable 17 may be omitted. In such case, the tethers 4 may extend directly to anchorages provided above the level of the buoyancy member 3. The use of a catenary cable 17, as shown, is suited, for example, to steep-sided valley sites.

Also shown on FIG. 7 is a typical irregular shape for the membrane 2 where the longest dimension in the direction of flow is at the deepest part of the river. The dimension of the membrane 2 across the direction of flow is sufficiently longer than the developed length of the river bed cross-section to provide a margin of cover above the highest operational water depth in the valley, to prevent bypass flow.

Figure 8:
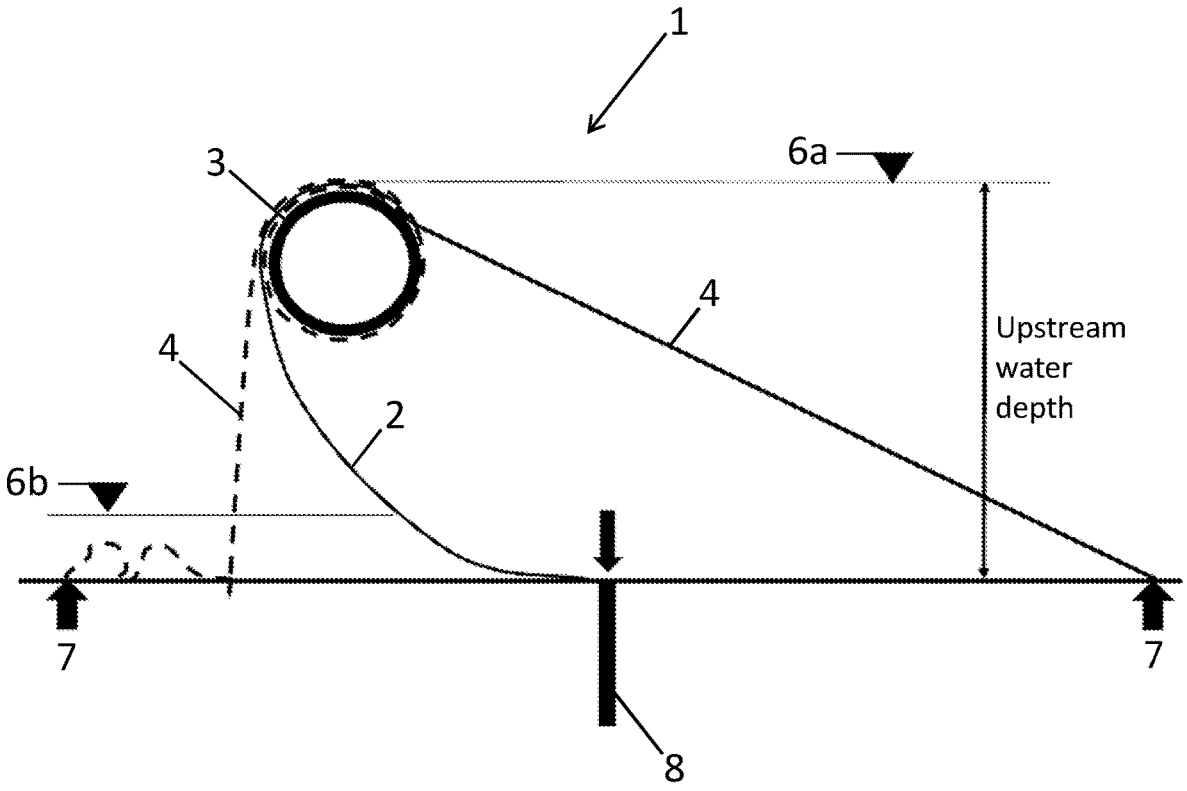
FIG. 8 shows a side view of a weir according to a bi-directional configuration installed across a body of flowing water.
Figure 9:
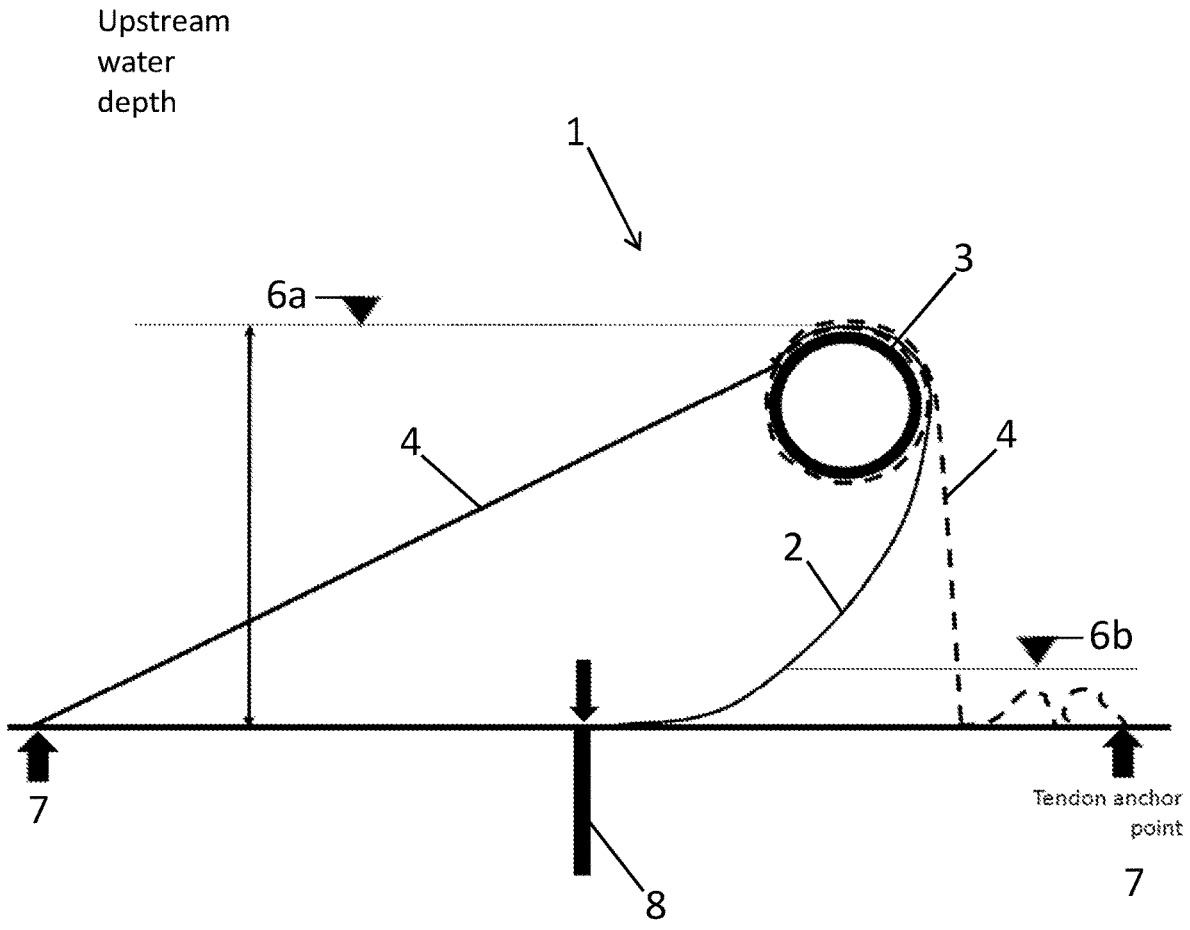
FIG. 9 shows a side view of the bi-directional configuration of FIG. 8 installed across the same body of water but with the water flowing in the opposite direction.

FIGS. 8 and 9 show cross-sectional views of a weir 1 configured for bi-directional flow. Such an arrangement may, for example, be implemented in tidal conditions. The membrane 2 may be anchored to the top of the seepage barrier 8, as shown, or any alternative suitable anchorage in the same central location may be provided.

The flow in FIG. 8 is shown from right to left, thereby holding (left hand) tethers 4 which are in function, in tension. However, a second set of tethers 4 are installed, which are attached to the same point (20, FIGS. 10 and 11) on the cross-section of the buoyancy member 3. The second tethers are preferably offset from the first tethers. In the depicted arrangement, the second tethers extend underneath the membrane 2, between membrane 2 and buoyancy member 3 for approximately half the circumference of the buoyancy member 3 and then make nearly a full further turn around buoyancy member 3 outside of membrane 2 to hang slack and out of function adjacent to the respective tether anchor points 7, as shown.

In FIG. 9, the flow is reversed, with flow from left to right. The tendons in function in FIG. 8 (the right hand tethers) are now out of function and vice versa. Note that as buoyancy member 3 traverses from left to right as the flow direction changes from FIG. 8 to FIG. 9, the out of function tethers 4 in FIG. 8 becomes the tethers 4 in function in FIG. 9 as they take the tension from the tidal flow hydrostatic pressure. The membrane 2 is now folded over symmetrically onto the other side of its anchor point 8. Note that as this process of lateral translation takes place as the tide reverses, the new upstream tethers 4 coming into function as they start to take the tension will rotate the buoyancy member 3 anti-clockwise by approximately one and a half turns, spooling out the in-function tethers 4 and spooling in some of the slack in the out of function tethers 4.

It should be appreciated that the arrangement shown is merely one of a number of bidirectional configurations.

Figure 10:
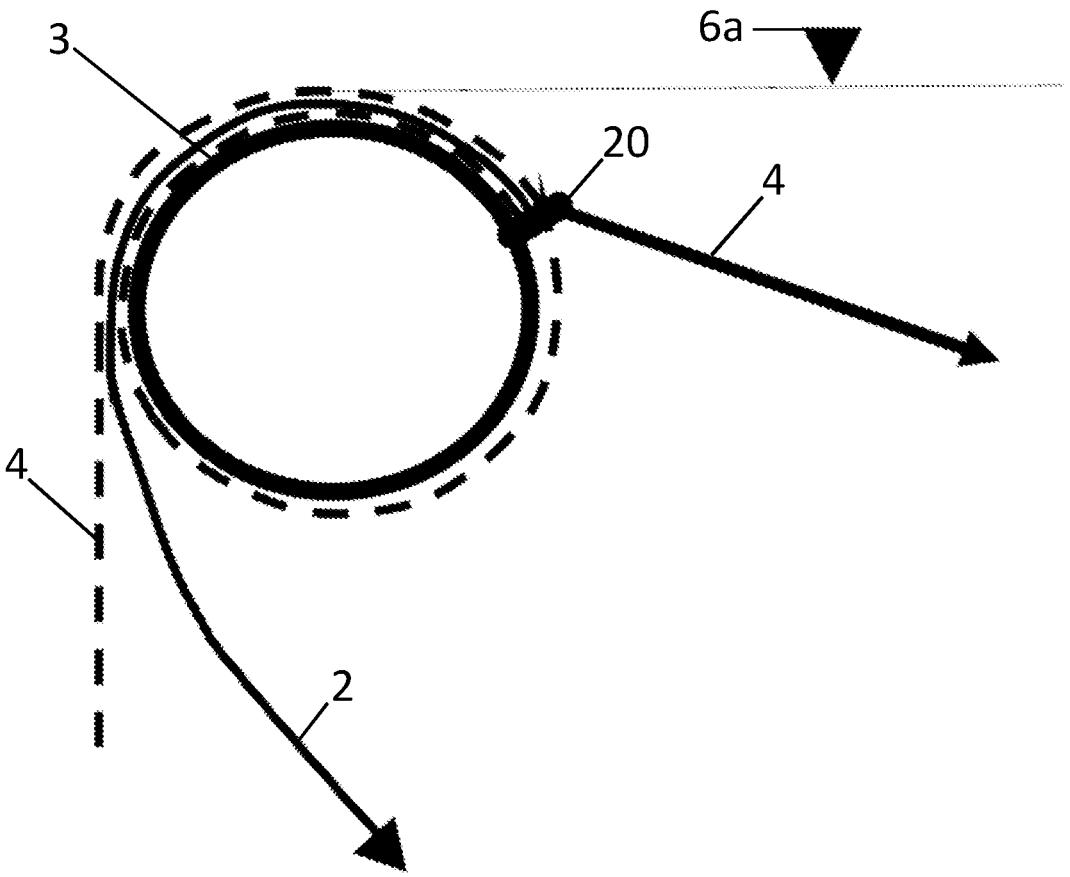
FIGS. 10 and 11 show enlarged views of the buoyancy element and tethers from FIGS. 8 and 9.
Figure 11:
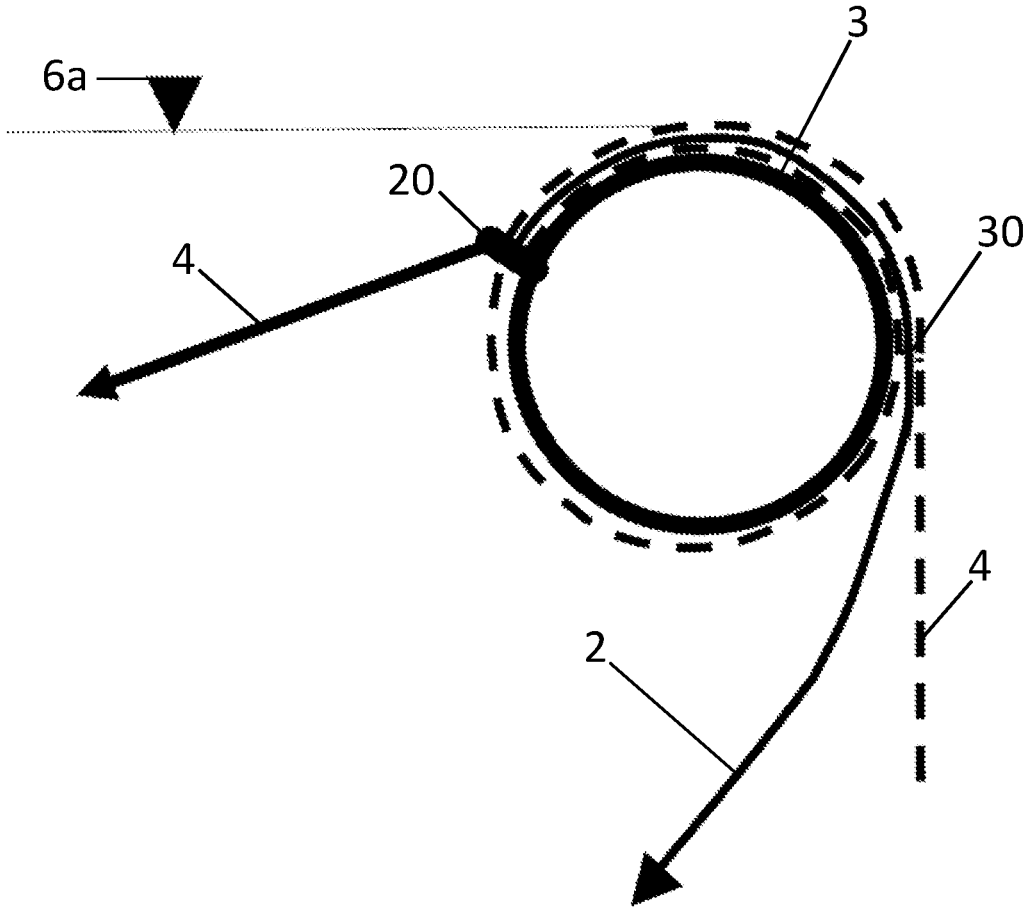

FIGS. 10 and 11 show close up views of the buoyancy member as shown in FIGS. 8 and 9, respectively.

Figure 12:
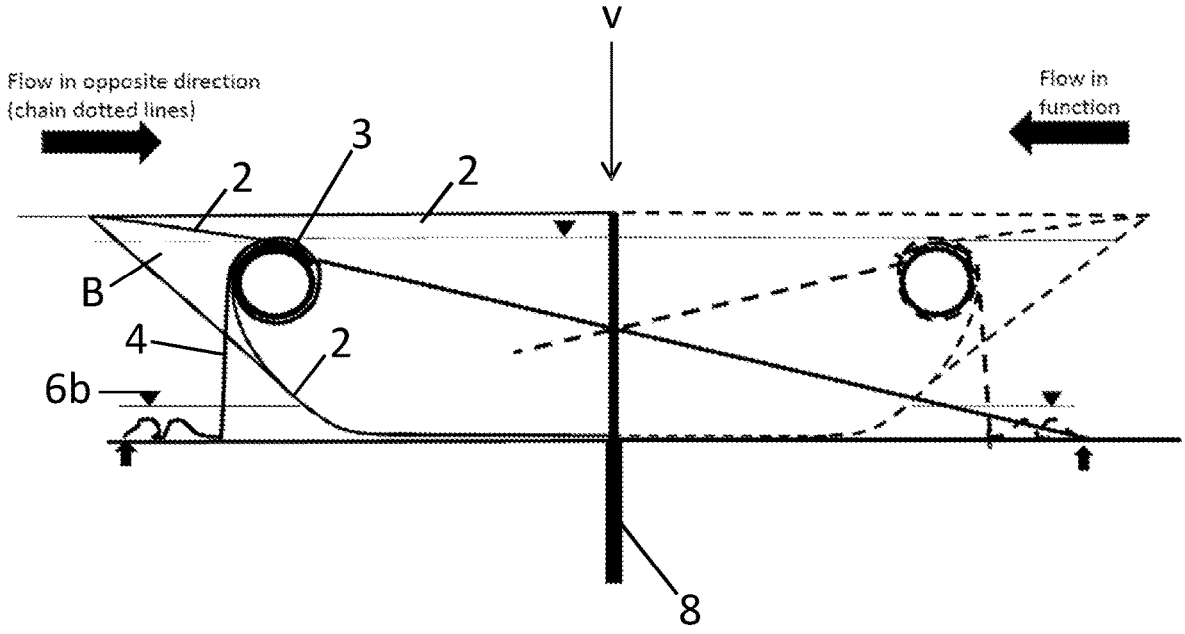
FIG. 12 shows the bi-directional configuration of the weir deployed between parallel vertical structures in a tidal flow.

FIG. 12 shows the complete translation of a weir 1, which has a configuration similar to the weir 1 shown in FIGS. 8 to 11, as the tide reverses. The view represents an end elevation, rather than cross-section, wherein the weir in the depicted arrangement stretches between two vertical walls 21, as shown in the plan view of the arrangement in FIG. 13. As indicated by the right hand arrow, the active flow in FIG. 12 is from right to left, wherein the detail in solid lines shows the active position of the weir components. The detail shown in broken lines is representative of the position of those components in the event there is a flow reversal.

The membrane 2 is attached on a vertical centre line v up the wall 23 above the anchor 8. The edge of the membrane 2 is folded against the wall to permit free movement of the buoyancy member 3 as the water level and flow direction changes. Note in this way that the membrane forms a bight B stretching out a short distance downstream of the buoyancy at each of the buoyancy ends such that the top level of the membrane in the bight B at no point will fall below the top of the buoyancy and will be folded away from rather than dragged across the surface of the end wall to minimise abrasion damage to membrane 2. Note also that the membrane 2 is held against the end wall by water pressure and rises to above the high water mark to minimise seepage losses.

Figure 13:
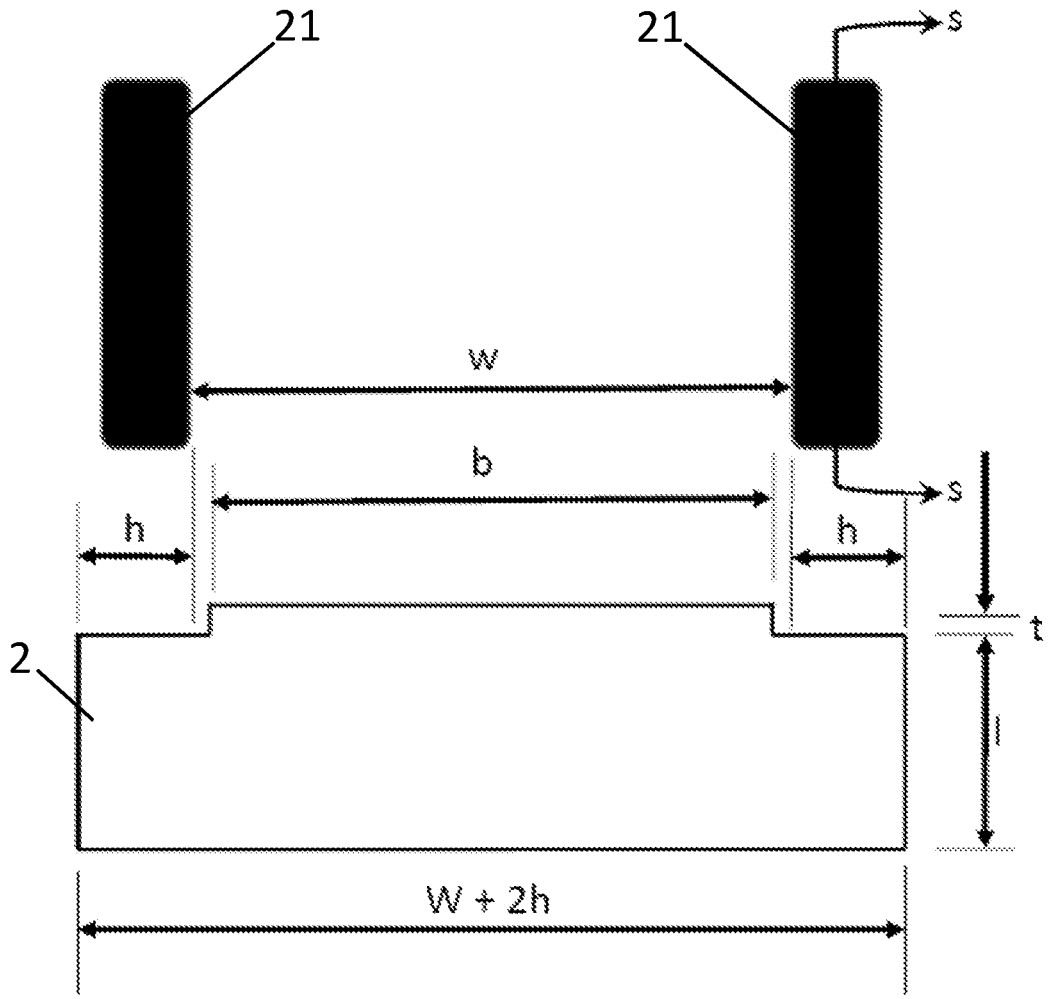
FIG. 13 shows the developed shape of the membrane of the configuration shown in FIG. 12, and also shows that renewable energy devices can be installed in the channel walls to generate power from the head of water created by the weir.

As mentioned, FIG. 13 is a plan view of the bi-directional weir 1 shown in FIG. 12. The weir 1 runs between the two vertical channel walls 23. Typically to install a weir across a wide body of water there can be multiple parallel channel walls 23 of this type with weirs between adjacent walls where appropriate. If the distance between two adjacent channel walls is w then the length b of the buoyancy member 3 will be less than dimension w. This ensures that the buoyancy member 3 can move vertically and translate horizontally without undue friction between the buoyancy member 3 and channel walls 23 nor between the two opposing surfaces of both bights B at opposite ends of the buoyancy member 3.

FIG. 13 also shows a preferable developed shape of the membrane 2. In this example, a flat horizontal river or sea bed between adjacent channel walls 23 is assumed for simplicity. If the height of the top of the membrane 2 as shown on FIG. 13 is h above the river or sea bed and the developed length of the membrane 2 is l then its area is l*(w+2h). To this area should be added that of a small tongue to part-wrap the buoyancy member 3 with a width of b as shown and with an extension length t equal to the length of the sector of the circumference of buoyancy member 3 between the upper touchdown point 30 of the membrane 2 onto the circumference of the buoyancy member 3 and attachment points 20 of the membrane 2 and tendons 4 onto the buoyancy member 3. FIG. 13 also shows the small clearance between buoyancy member 3 and the channel walls 23.

FIG. 13 also discloses that a renewable energy generator (42) or generators can be installed inside the vertical channel walls (37) in the direction of flow.

Figure 14:
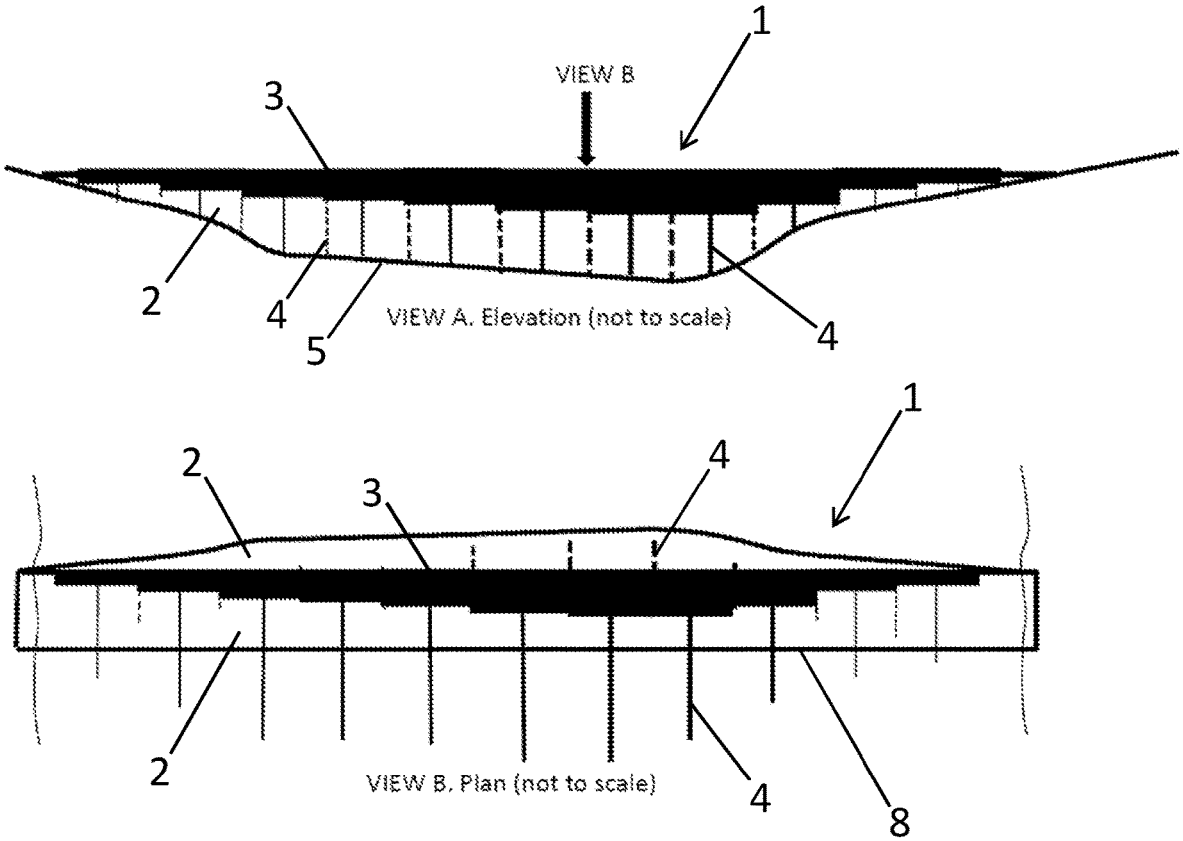
FIG. 14 shows the bi-directional configuration of FIG. 8 in elevation and plan views deployed across a river or estuary in a tidal flow.

FIG. 14 shows a bi-directional buoyant weir 1, which is configured in accordance with FIGS. 8 to 11, installed across a tidal river mouth or other body of tidal water which has a non-uniform bed profile and no channel walls in plan and elevation views. As will be appreciated, the slack tethers 4, which are out of function, are shown in dotted lines. The in function tethers 4 are shown in solid lines. It should be appreciated that a suitable bi-directional power generation means may be installed with the arrangement of FIG. 14, in a similar manner as discussed with respect to the power generation means discussed with respect to FIG. 6 above, as appropriate.

Figure 15:
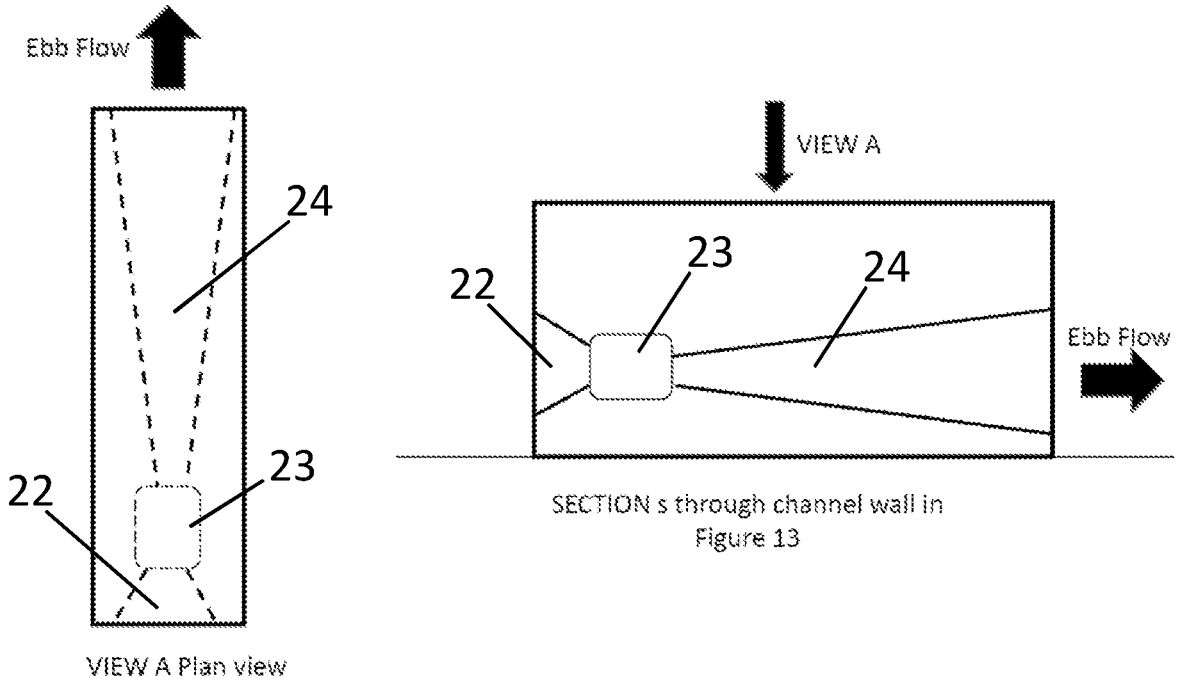
FIG. 15 shows the general disposition of a renewable energy devices installed in the channel walls shown in FIG. 13, used to generate power from the head of water created by the weir.

FIG. 15 presents a schematic sectional view through the line s in FIG. 13. Also shown in FIG. 15 is a corresponding plan view. FIG. 15 shows an exemplary renewable energy generator configuration, which includes a converger 22 arranged to lead water into a generator 23 and a diffuser 24 downstream of the generator 23. Such a uni-directional generator may be used, for example, in Ebb Flow generation and in preferred configurations could utilise a single or multiple low-head device(s). The depicted arrangement could also be used in the arrangement of FIG. 6. Bi-directional operation can be achieved either by the provision of a second power generation device facing in the opposite direction with appropriate sluice gates to suit the flow direction; or by an inherently bi-directional low-head device or devices, which may comprise a converger and diffuser having a substantially identical form.

Figure 16:
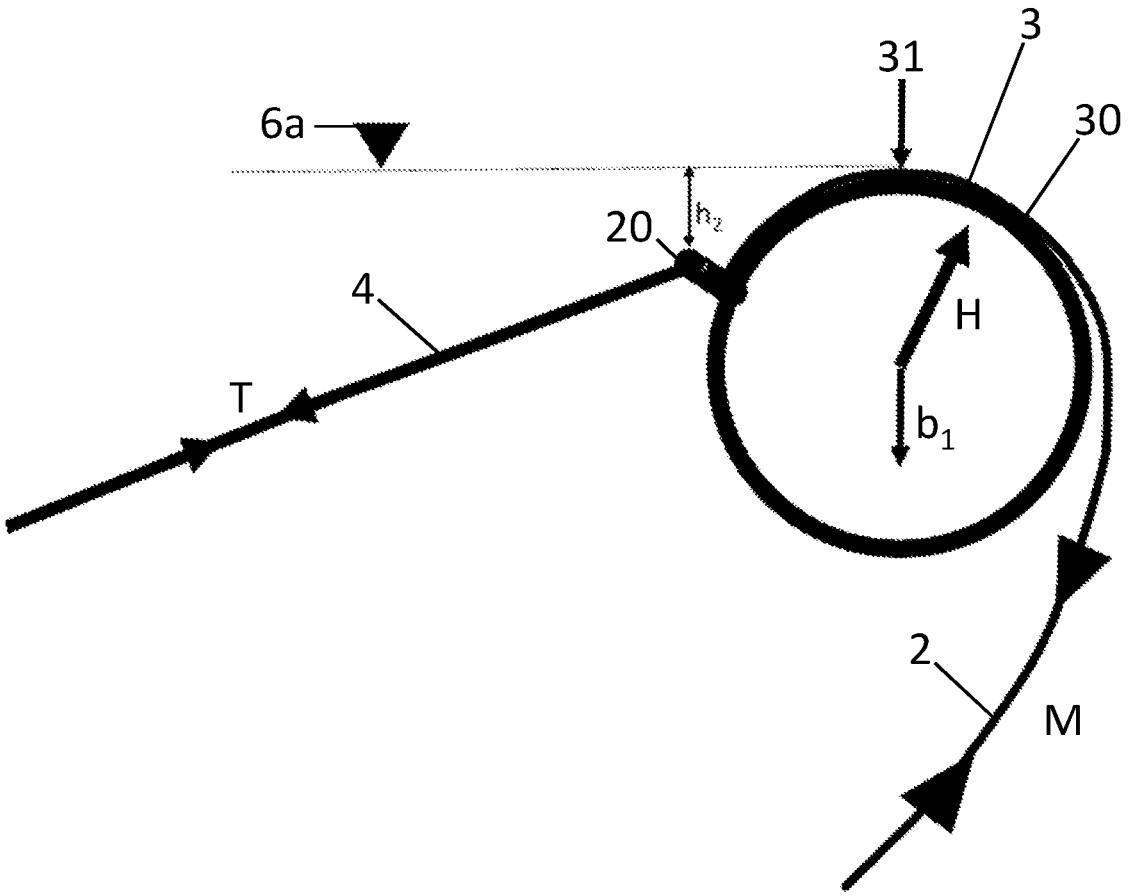
FIG. 16 shows details of the buoyancy element in FIG. 3, and identifies the upper touchdown point of the membrane onto the buoyancy member.

FIG. 16 shows a close up schematic view of the buoyancy member 3 of an exemplary arrangement of the weir 1 configured for uni-directional flow. This view is provided to allow for further discussion of the operating principles/design considerations of arrangements according to the present disclosure. In FIG. 16, the situation is shown in which the upstream water level 6*a* is just tangential to a top dead centre point 31 of the buoyancy member 3. The tendons 4 and the membrane 2 are attached to the buoyancy member 3 at attachment point 20, which lies a distance h 2 vertically below the upstream water level 6*a*. The upper touchdown point 30 of the membrane 2 is where the hydrostatic pressure keeping the membrane 2 and the buoyancy member 3 apart exactly equals the radially inwards pressure of the membrane 2 under its Tensile force M. FIG. 16 also shows the tethers 4 to be under tensile force T and the buoyancy member 3 to have a self-weight $b_1$. Note that there is no external hydrostatic force on buoyancy member 3 between the top dead centre 31 and the upper touchdown point 30 of the membrane 2. The hydrostatic buoyancy force H is therefore angled slightly downstream as indicated.

Figure 17:
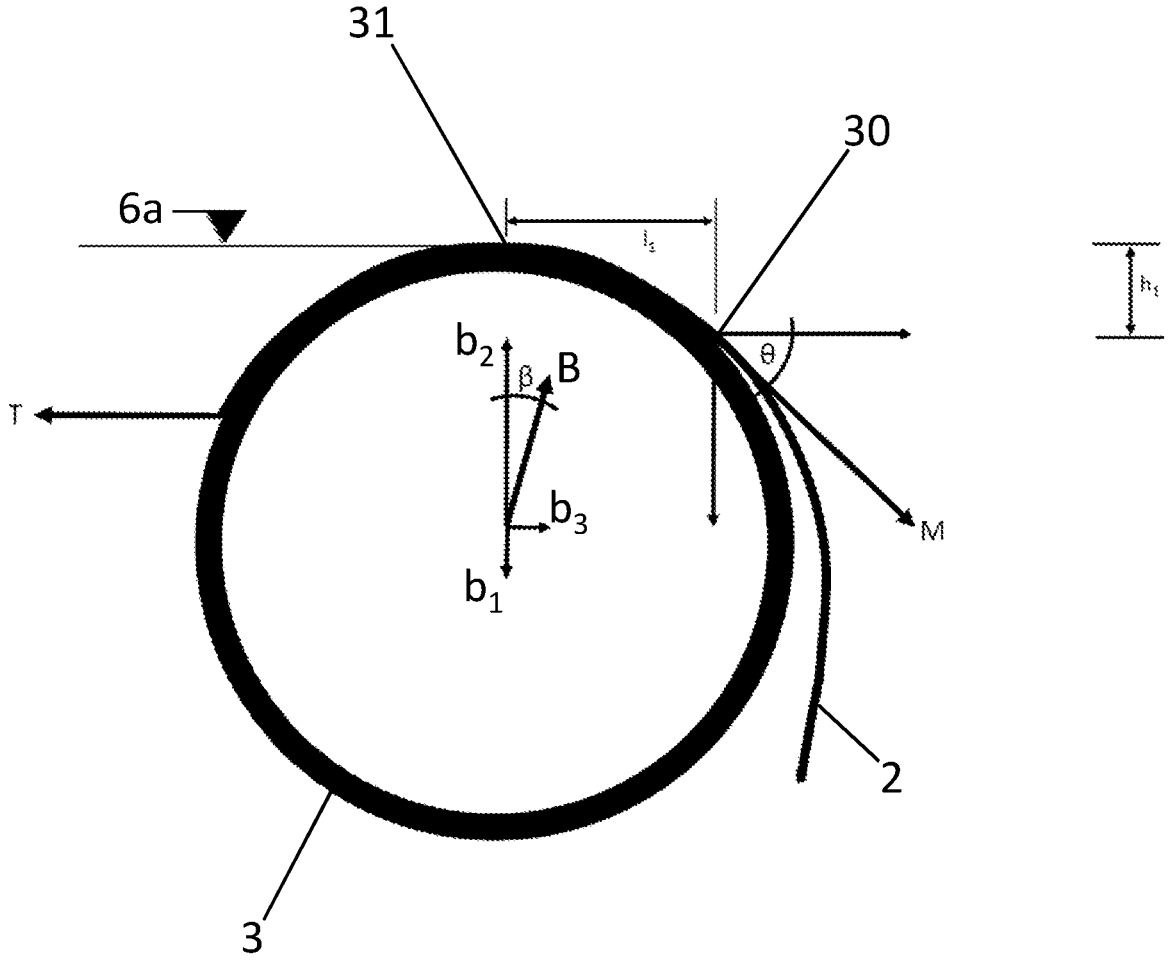
FIG. 17 in an expansion of FIG. 16 documents the forces that act upon the buoyancy element as the basis for determining the height of the head of water retained behind a weir.

FIG. 17 gives further detail of the forces acting on buoyancy member 3 in FIG. 16 and their geometric relationships, sufficient to permit calculation of the dimensional configuration of any given weir 1 when the upstream water level 6*a* is tangential to the top dead centre 31 assuming that the self-weights of the tendons 4 and the membrane 2 are also known or assumed negligible. The parameters discussed in respect of FIG. 3 will also be taken into account, as will be readily appreciated by those skilled in the art.

Tensile force T may be assumed to be horizontal at all times as an initial simplifying assumption. The upper touchdown point 30 of the membrane 2 is below the top dead centre 31 and spaced by a distance $l_1$ downstream of it. Tensile force M makes an angle θ with the horizontal at the upper touchdown point 30 of the membrane 2. Vertical displacement force $b_2$ is the buoyancy that would apply if fully submerged, removing the vertically downwards component of the hydrostatic forces that would be experienced between the top dead centre 31 and the upper touchdown point 30 of the membrane 2. Likewise, horizontal displacement force $b_3$ is the horizontal upstream component of the hydrostatic forces that would be experienced between the top dead centre 31 and the upper touchdown point 30 of the membrane 2 if the buoyancy member 3 were fully submerged. The net buoyancy B and its angle β to the vertical may be calculated by resolving forces $b_1$, $b_2$ and $b_3$, as will be readily appreciated by those skilled in the art.

Calculation of the dimensional configuration of any given weir 1 constructed under the principles of the present disclosure can then be completed by making allowance for the angle of inclination a (as discussed with reference to FIG. 3) of tethers 4 and for the hydrodynamic forces of any flow over the top of the weir 1, as will be further readily appreciated by those skilled in the art.

Figure 18:
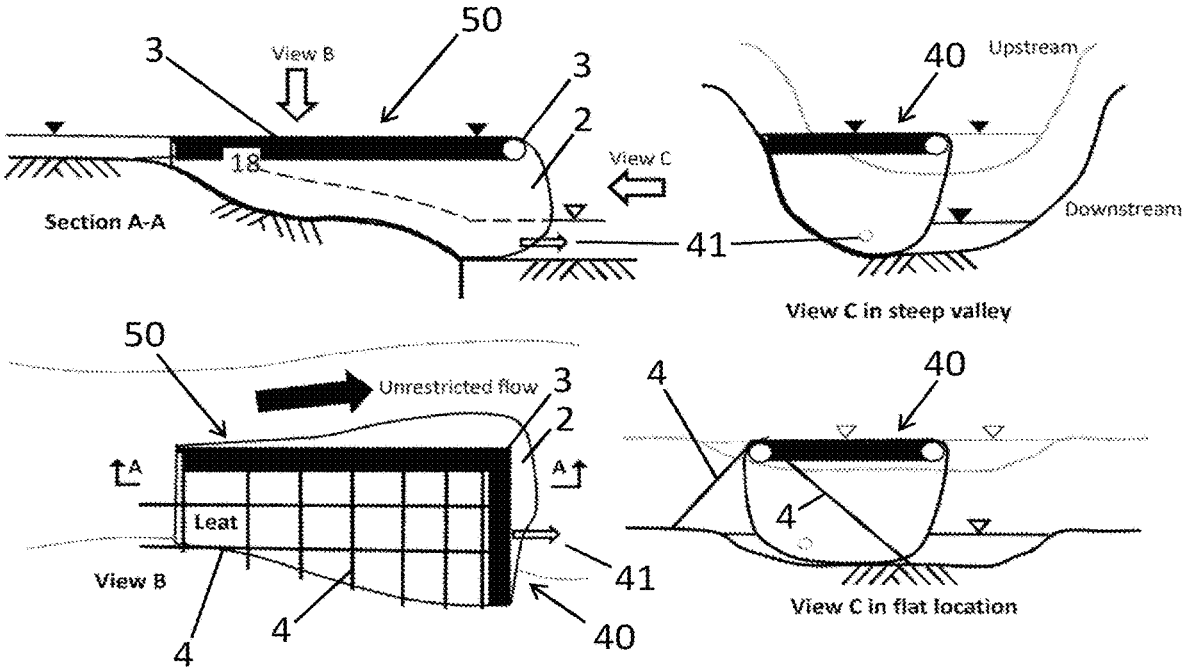
FIG. 18 discloses a further configuration of a buoyant weir to form a least part-way across a flowing body of water, leaving unrestricted access through the rest of the body of water.

FIG. 18 discloses an exemplary configuration of the weir running part-way across a water course and then turning to run upstream to a point where the increased elevation of the upstream water surface is sufficient to provide hydropower or serve some other utility.

The arrangement is such as to define a leat. In this arrangement, the weir comprises a first section 40, which extends part-way across the watercourse, most preferably substantially perpendicular to the flow direction, and a second section 50, which extends at an angle to the first portion in an upstream direction. The second section 50 is most preferably substantially perpendicular to the first section 40, as shown in the exemplary depicted arrangement. By such arrangement, there is provided a substantially L-shaped weir. The first and second sections could, however, be provided at different angles to one another. Moreover, curved weir arrangements are possible, as will be readily appreciated by those skilled in the art. The leat thereby formed is most economically configured where the ground level of the bed of the water course is sloping significantly downstream. The membrane 2 may be terminated and anchored on a seepage barrier 8 or other anchorage as described above or may completely cover the entire wetted surface of the leat where the permeability of the underlying geology so dictates.

As indicated at 41, a suitable renewable energy offtake is preferably provided.

Where the river banks are not characteristically steep sloping, it may be desirable to have two longitudinal leat walls running parallel to the flow tied together with tethers and stabilised against excessive sideways movement, as shown on FIG. 18.

Although the invention has been described with reference to the installation of the buoyant weir across a river or tidal estuary, it can also be installed in other bodies of water for example canals and offshore coastal defence fences.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

Although certain example embodiments of the invention have been described, the scope of the appended claims is not intended to be limited solely to these embodiments. The claims are to be construed literally, purposively, and/or to encompass equivalents. Numerous alternative arrangements will be readily appreciated by those skilled in the art within the scope of the claims.

The invention claimed is:

1. A weir comprising:

a water impervious flexible membrane;

a buoyancy member; and a tether, wherein, in use, the membrane comprises a lower edge portion and an upper edge portion, the lower edge portion is fixed with respect to a bed of a body of water, the membrane and the buoyancy member are attached to one another in the upper edge portion, and the tether comprises a first end portion, which is attached to the buoyancy member, and a second end portion that is attached to an anchorage, wherein the membrane and the tether are attached to the buoyancy member at a common point on an outer surface of the buoyancy member as viewed in cross-section, the membrane is wrapped partially around the buoyancy member, and the membrane and the tether extend away from the common point in opposed directions.

2. A weir as claimed in claim 1, wherein the buoyancy member comprises a manifold through which water can be introduced into an interior of the buoyancy member.

3. A weir as claimed in claim 2 wherein the manifold is connected to a pump.

4. A weir as claimed in claim 1 further comprising a trench in the bed of the body of water for receiving the buoyancy member in a lowered position.

5. A weir as claimed in claim 1, wherein a seepage barrier is provided in the lower edge portion of the membrane, which the seepage barrier penetrates the bed of the body of water.

6. A weir as claimed in claim 5, wherein the seepage barrier extends substantially vertically into a substrata of the bed of the body of water.

7. A weir as claimed in claim 1, wherein the weir is sited in open water, and the membrane is configured such that it is sufficiently both strong and flexible to accommodate wave action by moving with wave particle motion of the open water.

8. A weir as claimed in claim 1, wherein the lower edge of the membrane lies upon the bed of the body of water and is anchored to the bed of the body of water or weighed down by material placed thereupon.

9. A weir as claimed in claim 8, wherein the material comprises engineered back fill or one or more weighted members.

10. A weir as claimed in claim 1, wherein the anchorage is provided at a vertical height below the buoyancy member.

11. A weir as claimed in claim 10, wherein the anchorage is provided on the bed of the body of water.

12. A weir as claimed in claim 1, wherein the anchorage is provided at a vertical height above the buoyancy member.

13. A weir as claimed in claim 12, wherein the anchorage comprises a catenary cable to which the tether is attached.

14. A weir as claimed in claim 1, wherein the buoyancy member has a circular profile.

15. A weir as claimed in claim 1, wherein the buoyancy member comprises a plurality of buoyancy elements that are joined to one another.

16. A weir as claimed in claim 15, wherein two or more of the buoyancy elements have different buoyancies to one another.

17. A weir as claimed in claim 1 comprising a pair of spaced walls, wherein the buoyancy member extends between the walls.

18. A method of generating energy from a body of water comprising:

providing a weir according to claim 1 across a body of water;

creating a bypass path, opening upstream of the weir, to divert a volume of water from the body of water through the bypass path and back into the body of water downstream of the wier;

providing an energy converting device in the bypass path; and operating the device to generate electricity from the water as it flows through the bypass path.

* * * * *